United States Patent [19]

Callegari et al.

[11] 4,077,525

[45] Mar. 7, 1978

[54] DERRICK MOUNTED APPARATUS FOR THE MANIPULATION OF PIPE

[75] Inventors: Stephen R. Callegari; James D. Moncus; Roland George Harper, Jr., all of Lafayette, La.

[73] Assignee: Lamb Industries, Inc., Lafayette, La.

[21] Appl. No.: 523,677

[22] Filed: Nov. 14, 1974

[51] Int. Cl.[2] ..... E21B 19/14

[52] U.S. Cl. ..... 214/2.5; 175/85; 214/1 BC; 214/1 P

[58] Field of Search ..... 214/2.5, 1 BC, 1 P, 214/1 BB, 1 CM, 146.5, 1 BD; 114/.5 D; 175/85

[56] References Cited

U.S. PATENT DOCUMENTS

| | | | |
|---|---|---|---|
| 3,212,649 | 10/1965 | Johnson | 214/1 BC |
| 3,840,128 | 10/1974 | Swoboda | 214/2.5 X |
| 3,888,362 | 6/1975 | Fletcher | 214/1 CM |

*Primary Examiner*—Drayton E. Hoffman
*Assistant Examiner*—George F. Abraham
*Attorney, Agent, or Firm*—Fulbright & Jaworski

[57] ABSTRACT

Derrick mounted apparatus for the manipulation of lengths of pipe in or out of one or more finger boards in proximity thereto comprising a pipe manipulating arm adapted to move along a single predetermined line and a pipe gripping hand rotatably attached to one end of the pipe manipulating arm, the pipe gripping hand being capable of accepting and discharging pipe in an angular direction with respect to the line of movement of the arm.

9 Claims, 9 Drawing Figures

85
81
83
84
80
28
68
58
38
26
180°
34
32
36
40
24
31
66
64
63
62
63a
60
61

DERRICK MOUNTED APPARATUS FOR THE MANIPULATION OF PIPE

BACKGROUND OF THE INVENTION

1. Field of the Invention

This invention relates to derrick mounted apparatus useful in the manipulation of lengths of pipe in or out of one or more finger boards in proximity thereto; more particularly, this invention relates to such derrick mounted apparatus including a pipe manipulating arm and a pipe gripping hand rotatably attached to one end thereof.

2. Description of the Prior Art

During the drilling of an oil well utilizing a rotary tool drilling rig, it is necessary from time to time to connect additional joints or lengths of drill pipe to the upper end of the drill string as the well is extended into the ground. Likewise, when the drilling operation is completed, lengths of drill pipe are periodically disconnected from the upper end of the drill string as the pipe is removed from the well. In the connecting of a length of pipe to the drill string, the length of pipe is vertically supported from a traveling block which normally is provided in a hoisting derrick erected over a rotary table used to rotate the drill string and thereby a rotary drilling tool secured to the lower end of the drill string. A similar vertical supporting of the drill pipe takes place when disconnecting lengths of pipe. The length of pipe which is vertically supported is generally of very substantial weight.

Originally, suspended lengths of pipe were moved manually into position for engagement with the upper end of the drill string projecting above the rotary table and likewise moved manually from engagement with the drill string to an area for storage. Due to considerations of personnel safety, particularly in connection with operations performed on floating vessels and with offshore platforms, where such manual operations can be quite hazardous, various devices have been developed to mechanically constrain and controllably move a vertically supported length of pipe in a drilling rig, both to connect and after disconnection of the length of pipe from the drill string.

The devices which have been proposed have generally been proposed for installation on the rig floor. Such devices are capable of grasping a length of pipe, rotating the length of pipe into the desired position, and finally, positioning the length of pipe for connection to the drill string. Typical examples of such rig floor mounted devices can be found in U.S. Pat. No. 2,450,934 to Calhoun and U.S. Pat. Nos. 3,371,728 and 3,477,527 assigned to Global Marine. A problem, however, still arises with respect to proper grasping and positioning of the upper portion of the length of pipe.

Lengths of pipe which are to be later attached to the drill string or which have been disconnected from the drill string are typically held in a racking board assembly attached to the upper portion of the derrick. One device which has been previously proposed for the manipulation of the drill pipe in or out of the racking board is illustrated, for example, in U.S. Pat. No. 2,416,815 to Calhoun. This patent illustrates an apparatus with pipe engaging jaws attached to an arm which provides for retraction of the jaws and release of a pipe engaged thereby, the entire assembly being mounted on the derrick adjacent the racking board. Certain limitations are inherent in this device, however, in that the pipe engaging jaws work only to release or engage the lengths of pipe and the jaws or head section of the apparatus are not capable of movement independent of the arm or body of the device to provide the desired flexibility in orientation and manipulation of the drill pipe. These deficiencies have made the type of device illustrated in the Calhoun patent somewhat less than satisfactory.

A further derrick mounted device for manipulating lengths of pipe in or out of a racking board is a device manufactured by Bryon Jackson, Inc., illustrated for example in *Composite Catalog of Oil Filed Equipment and Services,* 31st revision, 1974–75, Vol. 1, pp. 820–821. This device includes an upper racker and associated racking board, the racker consisting of a carriage which travels across the width of the derrick on tracks and an arm which is powered toward and away from the centerline of the well through the carriage and a hand fitted to the end of the arm.

This device, like the device of Calhoun, is quite complicated and does not allow independent directional rotation of the hand. All of the directional orientation of the hand is associated with movement of the entire arm on a carriage. The complexity of this device makes it very difficult to modify a well derrick in the field to include the device. This device, therefore, is also less than completely satisfactory.

SUMMARY OF THE INVENTION

Based upon the above, it is a principal feature of the invention to provide derrick mounted apparatus for the manipulation of lengths of pipe in and out of one or more finger boards, wherein such apparatus eliminates the deficiencies of the above described prior art, through the provision of a pipe manipulating arm adapted for movement along a single predetermined line and a pipe gripping hand rotatably attached thereto, whereby the pipe gripping hand can accept and discharge pipe in an angular direction with respect to the line of movement of the arm.

It is a further feature of the present invention to provide such derrick mounted apparatus for the manipulation of lengths of pipe in or out of one or more finger boards in proximity thereto, wherein the pipe manipulating arm telescopes and includes means operative to extend and retract the telescoping arm, and means operative to rotate the pipe gripping hand relative to the telescoping arm.

It is yet a further feature of the present invention to provide a pipe gripping hand for use in connection with apparatus for the manipulation of lengths of pipe, the gripping hand being rotatably attached to one end of an arm operably to move along a single predetermined line into proximity of lengths of pipe and including means operative to close or open the pipe gripping hand to accept or discharge a length of pipe, and means operative to rotate the pipe gripping hand relative to the arm.

A still further feature of the present invention comprises such apparatus for the manipulation of lengths of pipe in or out of one or more finger boards in proximity thereto, including a telescoping arm comprising a plurality of coaxial telescoping elements and at least one hydraulic cylinder therein, such hydraulic cylinder being operative to extend and retract the plurality of coaxial telescoping elements.

Another feature of the present invention relates to such derrick mounted apparatus for the manipulation of lengths of pipe in or out of one or more finger boards wherein the apparatus can be simply mounted in a fixed position within a well derrick without need for tracks to permit movement of the pipe manipulating arm while providing the pipe gripping hand access to pipe retained in one or more finger boards.

Yet further features and advantages of the present invention will become more apparent from the following more detailed description thereof.

The foregoing features of the present invention and the advantages associated therewith are achieved in accordance with the present invention through the provision of a derrick-mounted apparatus for the manipulation of lengths of pipe in or out of one or more finger boards in proximity thereto. Such derrick mounted apparatus in accordance with the present invention comprises:

a pipe manipulating arm adapted for movement along a single predetermined line; and a pipe gripping hand rotatably attached to one end of the arm, the pipe gripping hand being rotatable about the arm to accept and discharge pipe in an angular direction with respect to the line of movement of the arm. In a particular example, the derrick mounted apparatus in accordance with the present invention includes:

a telescoping arm comprising a plurality of coaxial telescoping elements;

means operative to extend and retract each of the plurality of coaxial telescoping elements;

a pipe gripping hand comprising first and second pipe engaging jaws rotatably attached to one end of the telescoping arm;

means operative to close or open the first and second pipe engaging jaws to accept or discharge a length of pipe, such means suitably being a double acting hydraulic cylinder linked to the gripping hand to open and close the first and second jaws upon application of hydraulic pressure; and means operative to rotate the gripping hand relative to the telescoping arm, preferably a pair of oppositely acting hydraulic cylinders and a chain drive connecting the gripping hand to the telescoping arm.

In accordance with one embodiment of the invention, the pipe gripping hand is rotatable at the end of the manipulating arm to enable it to be positioned at the end of the finger board to accept and discharge pipe. In accordance with a second embodiment, means are provided to extend the pipe gripping hand at an angle to the pipe manipulator arm to enable the gripping hand to reach any pipe stored in the finger board.

The apparatus of the present invention can be conveniently located adjacent one finger board or can be located between two finger boards so as to effectively and efficiently allow for the manipulation of lengths of pipe in or out of the same.

BRIEF DESCRIPTION OF THE DRAWINGS

The foregoing features of the present invention, as well as others, are more fully set forth in the following detailed description of the preferred embodiments of the invention, which description is presented with reference to the accompanying drawings, wherein.

DESCRIPTION OF PREFERRED EMBODIMENTS

Figure 1:
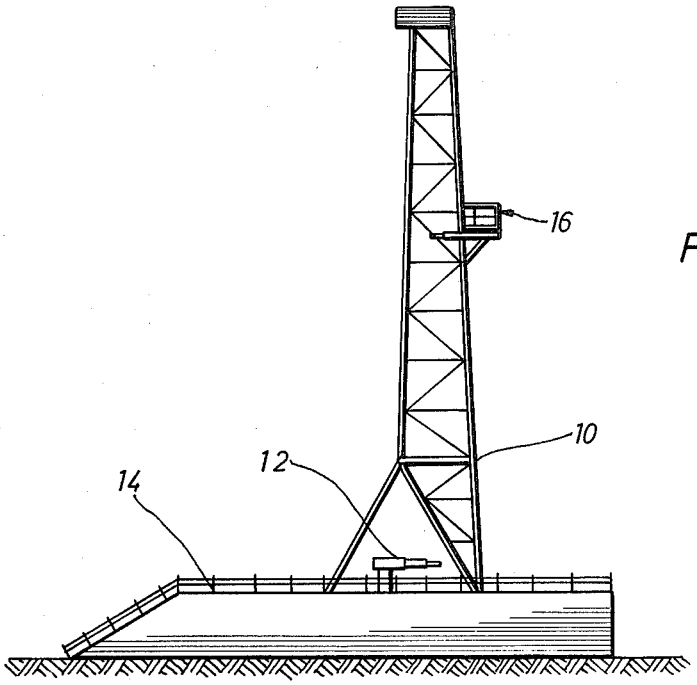
FIG. 1 is a side elevation view of an oil well derrick schematically illustrating conventional equipment used and the relationship of the apparatus of the present invention to such conventional equipment.

In FIG. 1, a conventional derrick 10 is illustrated, including a suitable device 12 on the rig floor 14 for grasping and manipulating a length of pipe so as to align the same with a rotary table, not shown. Such device 12 can be any suitable device, such as for example illustrated in U.S. Pat. No. 2,416,815 to Calhoun and U.S. Pat. Nos. 3,371,728 and 3,477,527. Other typical elements of the derrick and drilling rig such as the rathole, mousehole, well itself, etc., are not illustrated in the schematic of FIG. 1. In addition, while FIG. 1 schematically illustrates the use of a derrick 10 on a platform or rig floor 14 on land, the apparatus of the present invention can be conveniently affixed to any oil well derrick, including those employed on offshore platforms and on drilling vessels. The apparatus of the present invention finds particular applicability in the handling of pipe aboard a vessel under severe weather conditions where the motion of the vessel renders manual manipulation of the pipe hazardous and inefficient.

As illustrated in FIG. 1, racking board 16 is located on the upper portion of derrick 10. It will be understood that the device of this invention may similarly be used with a racking board mounted in a mast. The racking board 16 and the relationship of the apparatus of the present invention to the racking board can be more clearly seen by reference to FIG. 2, which is schematic only and not necessarily to scale.

Figure 2:
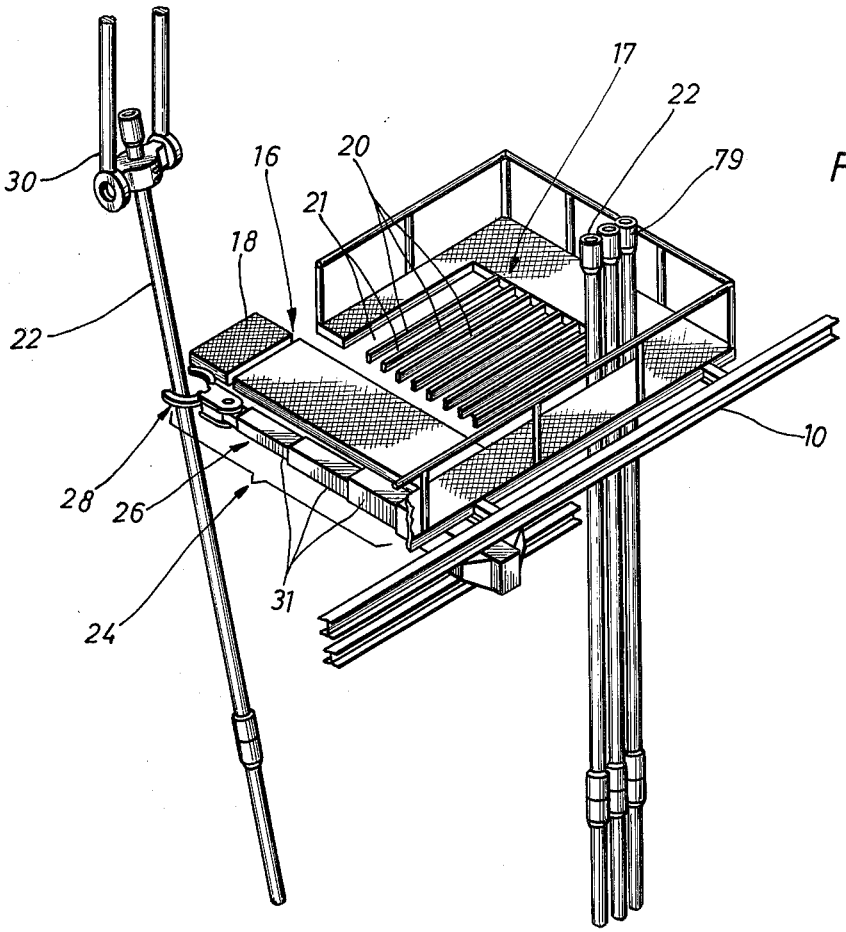
FIG. 2 is a perspective view of the apparatus of the present invention illustrating relationship of the derrick mounted apparatus for manipulation of drill pipe and the racking board.

As seen in the embodiment illustrated in FIG. 2, racking board 16 includes a platform or monkey board 18 capable of supporting the derrickman. Monkey board 18 is suitably centered above pipe manipulator device 24. Racking board 16 which includes the combination of the finger board 17 and the monkey board 18 is attached to derrick 10 and includes a plurality of fingers 20 which form spaces or grooves 21 for holding lengths of pipe 22. The lengths of pipe 22 are stored in the finger board 17 either prior to connection to the drill string during the drilling operation or after disconnection from the drill string.

As illustrated in the embodiment of FIG. 2, the derrick mounted apparatus 24 of the present invention is located in proximity to racking board 16. Preferably, apparatus 24 is located below racking board 16. In the alternative embodiment illustrated in FIG. 3, the apparatus 24 of the present invention can be conveniently located between two racking boards 16, so that apparatus 24 can efficiently manipulate lengths of pipe 22 in and out of both finger boards 17.

Figure 3:
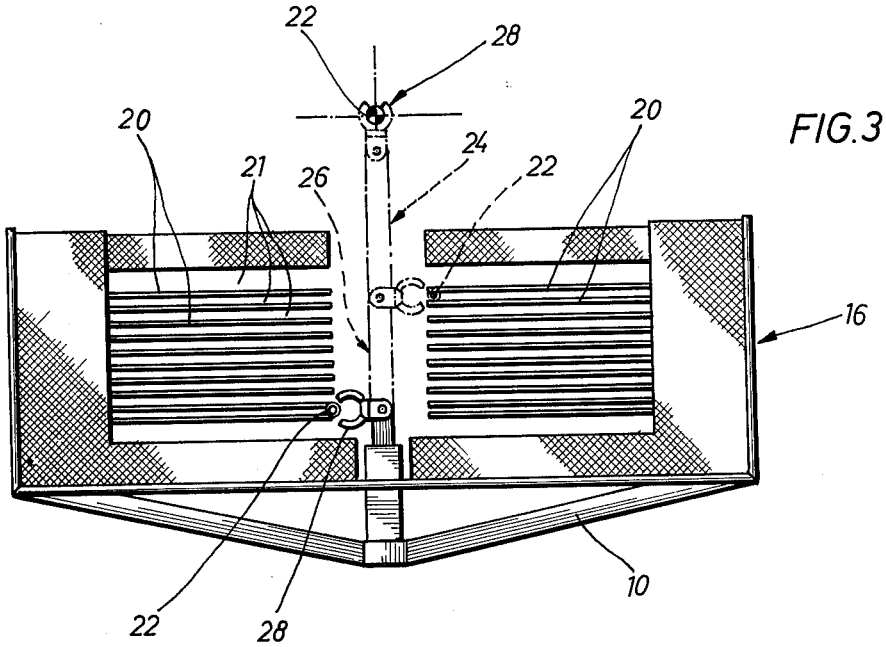
FIG. 3 is a top view of the apparatus of the present invention illustrating the relationship of the derrick mounted apparatus for manipulation of drill pipe and two finger boards.

As illustrated in the embodiment of FIGS. 2 and 3, apparatus 24 includes a pipe manipulating arm 26 and a rotatable gripping hand 28. When utilizing the apparatus of the embodiment of FIGS. 2 and 3, a derrickman standing on a platform or monkey board 18 need only manipulate the drill pipe 22 by hand to the extent of bringing a length of pipe to the end of the groove 21 formed by fingers 20. At that point, the length of pipe 22 can be grasped by gripping hand 28 in the manner illustrated in FIG. 3 and upon extension of arm 26 and rotation of gripping hand 28, the length of pipe 22 can be brought into proper position for interconnection with the drill string. A reverse operation is employed when disconnecting a length of pipe from the drill string for storage in the racking board. In such case, an elevator and bales 30 is utilized for the lifting and positioning of the length of pipe 22 prior to grasping with gripping hand 28 for reinsertion into racking board 16.

As seen from FIGS. 2 and 3 pipe manipulating arm 26 is adapted for movement along a single predetermined line, preferably a line normal to the length of fingers 20 and grooves 21 of finger board 17. Pipe gripping hand 28 is rotatably connected to one end of pipe manipulating arm 26 so as to be capable of rotation about arm 26 to accept and discharge pipe in an angular direction to the line of movement of arm 26. Pipe gripping hand 28 is preferably capable of at least 180° rotation, which, coupled with preferred movement of arm 26 normal to fingers 20 allows pipe gripping hand 28 to engage and release pipe in a direction normal to the line of movement of arm 26.

Figures 4, 6, 9:
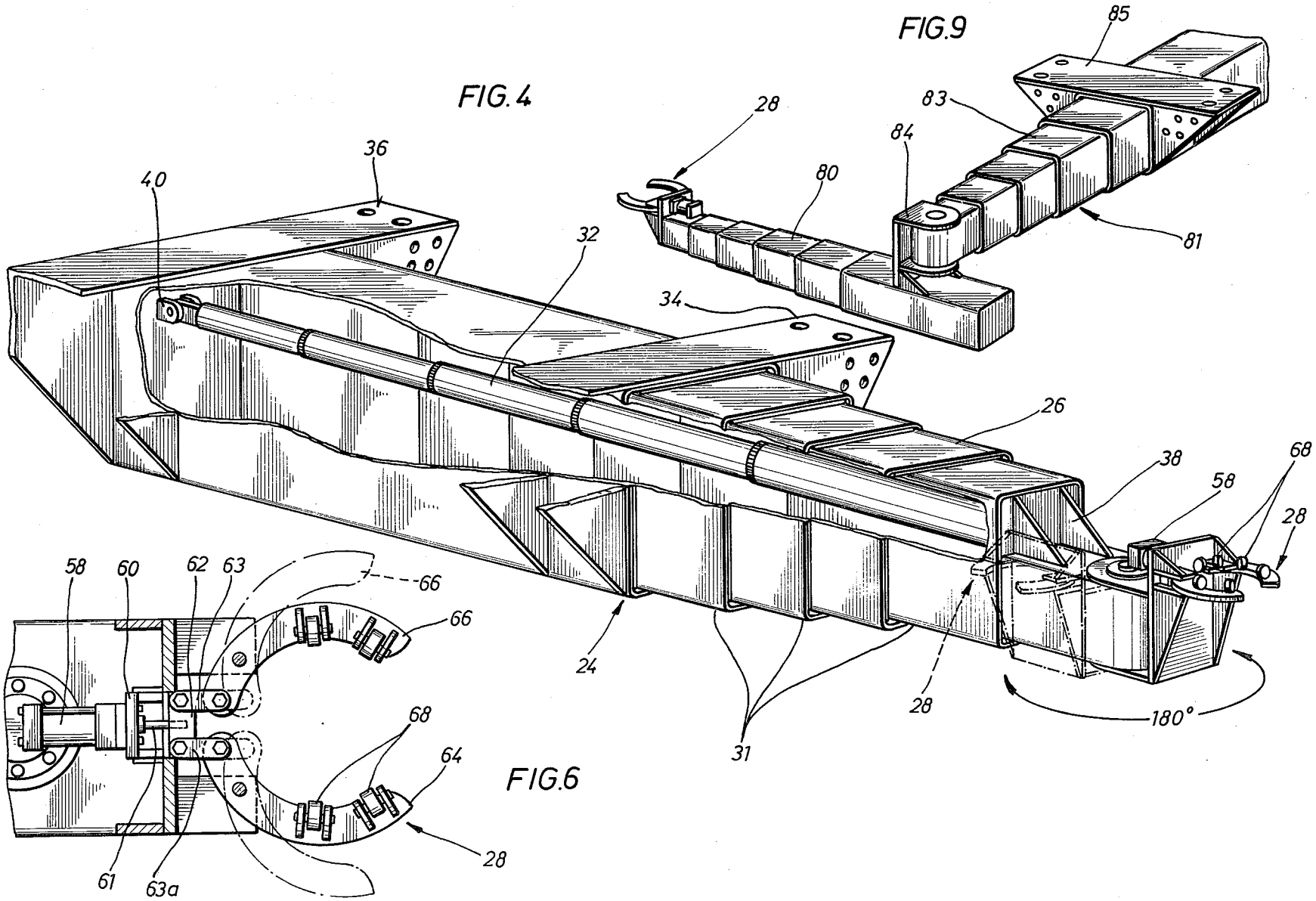
FIG. 4 is a partial cross-sectional view of the apparatus of the present invention illustrating 180° rotation of the gripping hand.
FIG. 6 is an enlarged view of the gripping hand of FIG. 5, illustrating the mechanism for opening and closing the gripping hand.
FIG. 9 is a perspective view of an alternate embodiment of a pipe manipulating device in accordance with this invention.

The preferred features of the derrick mounted apparatus of the present invention are more clearly seen by reference to FIG. 4. Referring to the embodiment of FIG. 4, a telescoping pipe manipulating arm 26 is preferably fixed at one end and capable of extending and retracting and is most preferably in the form of a plurality of coaxial telescoping elements 31, illustrated in FIG. 4 as coaxial telescoping box-like elements. While movement of arm 26 along a single predetermined line is preferably achieved by using a telescoping arm 26, arm 26 can suitably ride on a carriage, or any other mechanism capable of achieving the desired movement can be utilized.

In the preferred embodiment illustrated, the telescoping feature of arm 26 is provided by at least one multistage telescoping hydraulic cylinder 32 operative to extend and retract the plurality of coaxial telescoping elements 31. As an alternative to the telescoping hydraulic cylinder for extension and retraction of arm 26, any mechanical or electrical means to achieve the desired telescoping and retraction in accordance with this preferred embodiment can be used. For example, a rack and pinion mechanism might desirably be employed.

Apparatus 24 is mounted on derrick 10 by means of front mounting plate 34 and rear mounting plate 36 so that telescoping arm 26 extends and retracts along a single line. A single mounting plate may be used if desired. Hydraulic cylinder(s) 32 is mounted by means of cylinder mounting plate 38 and bracket 40.

As seen in the embodiment illustrated in FIG. 4, pipe gripping hand 28 is preferably capable of 180° rotation relative to arm 26. This feature of the derrick mounted apparatus of the present invention allows pipe gripping hand 28 to accept and discharge pipe in an angular direction, preferably normal, to the line of movement of arm 26 in a manner totally unlike any previously developed device.

Figure 8:
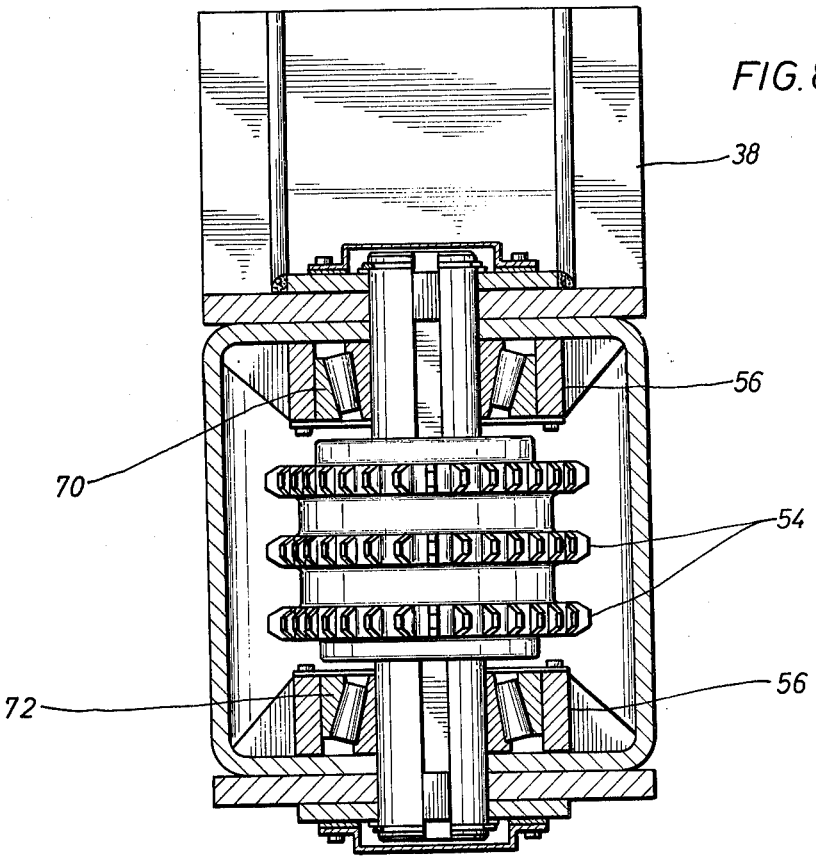
FIG. 8 is a partial cross-sectional view of the apparatus of the present invention taken along line 8—8 of FIG. 7.

The preferred apparatus for effecting the rotational movement of pipe gripping hand 28 relative to arm 26 and the acceptance and discharge of pipe is illustrated in FIGS. 5–8. The mechanism for rotating pipe gripping hand 28 relative to arm 26 preferably includes two oppositely acting hydraulic cylinders 44 and 44*a*. Rods 46 and 46*a* of hydraulic cylinders 44 and 44*a* terminate in connectors 48 and 48*a* which receive the ends of chain 52, passing over sprocket 54. Sprocket 54 is held by sprocket wheel mounts 56 and the rotation of sprocket 54 allows the 180° rotation of gripping hand 28 through bearings 70 and 72. The relationship of bearings 70 and 72 to sprocket 54 is illustrated in FIG. 8. Here again, while rotation of pipe gripping hand 28 is preferably carried out hydraulically in the manner described above, any other hydraulic system, and/or mechanical system capable of effecting the described rotation can be effectively utilized.

In the preferred embodiment of the present invention pipe gripping hand 28 is in the form of first and second pipe engaging jaws 64 and 66. Here again, however, any member or element capable of gripping pipe and allowing the required acceptance and discharge of pipe can be conveniently used in the apparatus of the present invention.

Figure 5:
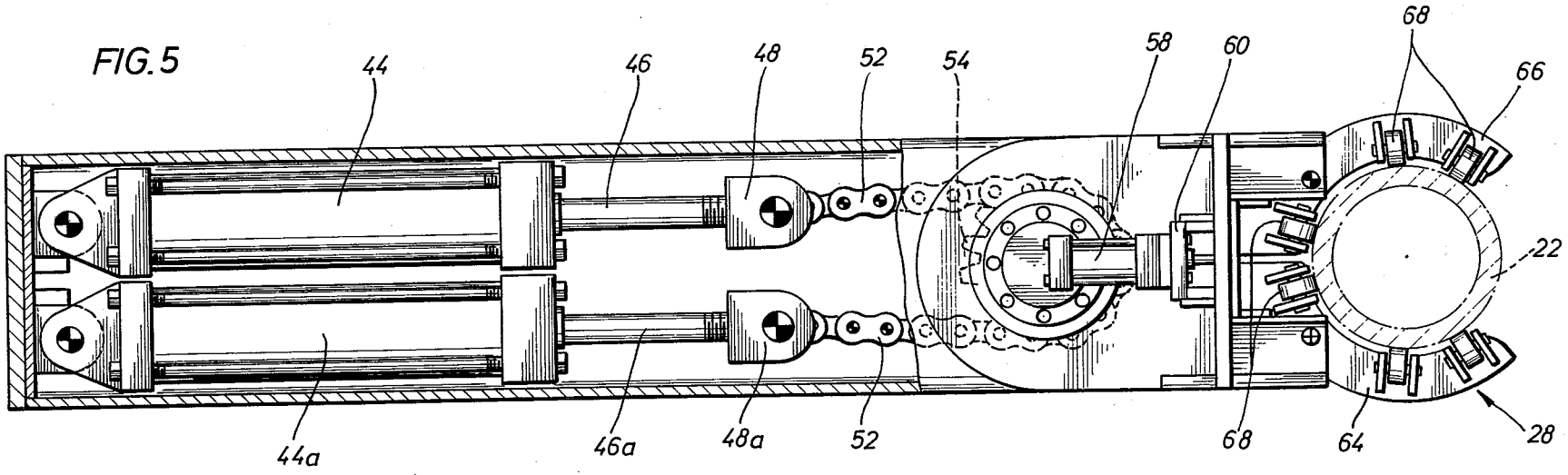
FIG. 5 is a top view, partially cut away, of the apparatus of the present invention.
Figure 7:
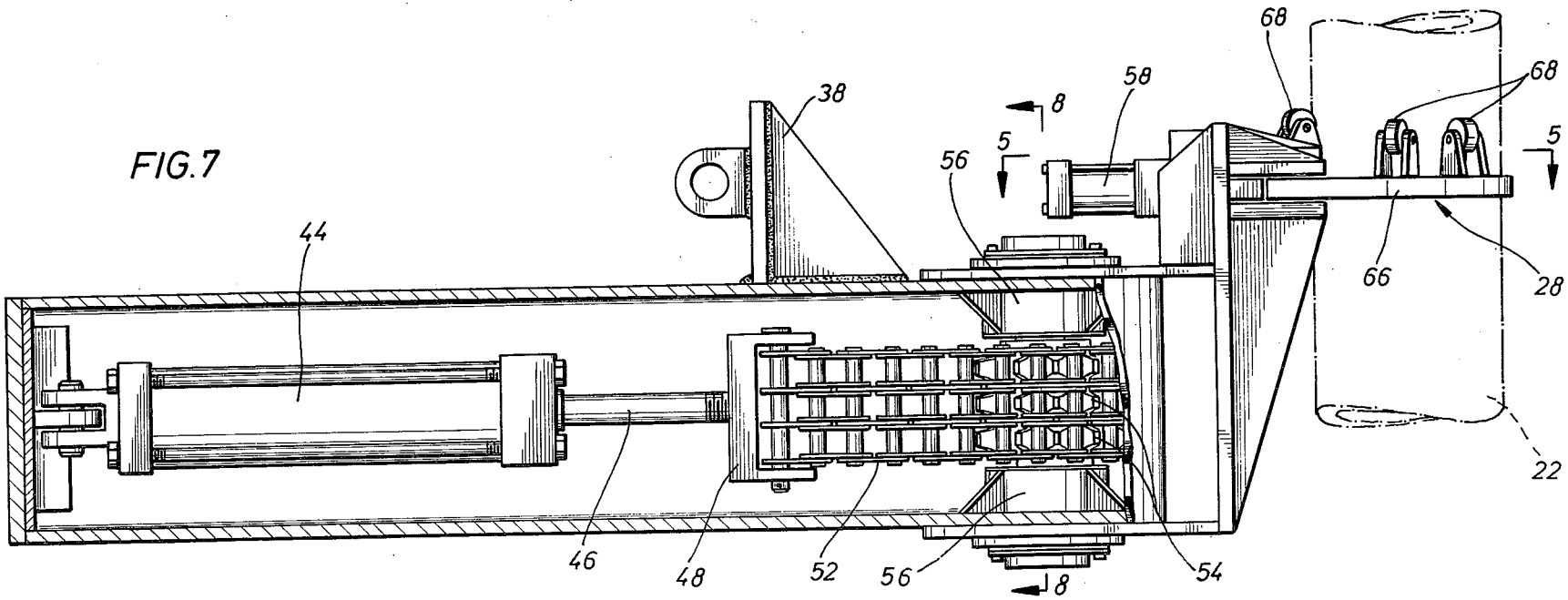
FIG. 7 is a side view, partially cut away, of the apparatus of the present invention.

The preferred mechanism for opening and closing of gripping hand 28 for acceptance and discharge of a suitable length of pipe 22 is illustrated in FIGS. 5 and 6. Turning specifically to the embodiment illustrated in these figures, hydraulic cylinder 58 is mounted on cylinder mount 60 and by rod 61 is connected to gripping hand 28 through plate 62 and plates 63 and 63*a* for the opening and closing of first and second pipe engaging jaws 64 and 66, making up gripping hand 28. As illustrated in FIGS. 5 and 7, gripping hand 28 includes a plurality of rollers 68 for contact with a length of pipe 22 when pipe engaging jaws 64 and 66 are in engagement therewith.

The derrick mounted apparatus of the present invention is useful primarily as a pipe handling device to assist the derrickman in handling drillpipe, drill collars, etc. The apparatus is preferably hydraulically actuated, and, as indicated, installed directly adjacent or beneath the monkey board. All functions necessary for moving pipe in or out of the racking board to a point over the centerline of the well bore can be carried out by the derrick mounted apparatus of the present invention, except for the movement of the pipe within the fingers of the racking board for loading or unloading. This is manually carried out by the derrickmen when using the FIG. 4 embodiment, but can be done automatically with an alternate embodiment as will be explained below. The controls which are not shown in the drawings, and which are utilized to control the various hydraulic cylinders or other elements of the derrick mounted apparatus can be conveniently vest mounted on the derrickman, or can be located on the racking board. In either event, the apparatus of the present invention can be very efficiently and quickly assembled and mounted on existing derricks.

Referring to FIG. 9, there is shown an alternate embodiment of the derrick mounted apparatus of the invention. In this alternate embodiment, the pipe manipulator arm remains fixed at one end in the derrick and extends or retracts along a predetermined line as in the embodiment of FIGS. 2, 3 and 4. However, in the embodiment of FIG. 9, pipe gripping hand 28 (the same numeral designation is employed to signify that a similar pipe gripping hand to that illustrated in the FIG. 2 embodiment and shown in detail in FIG. 6 can be used with that of FIG. 9) is attached to the end of extensible arm 80 which is rotatable about the fixed manipulating arm 81. Arm 81 is similar in structure to arm 26 in the FIG. 4 embodiment and includes telescoping sections 83 which may be extended or retracted by activating a multistage telescoping cylinder similar to that shown at 32 in FIG. 4.

Rather than terminating in a rotating gripping hand, arm 81 terminates in a rotatable bracket 84 which can be positioned to direct extensible arm 80 at an angle to manipulating arm 81. Desirably, the extensible arm 80 has a reach, in its fully extended position enabling gripping hand 28 to grip pipe located in the furthermost position in the finger boards (e.g., in position 79 shown in FIG. 2.) Thus, with the apparatus of FIG. 9, manual manipulation of the pipe to the ends of fingers 20 of the finger board is unnecessary.

Bracket 84 is secured to extensible arm 80. A chain and sprocket mechanism similar to that illustrated in FIGS. 5, 7 and 8 may be employed to rotate bracket 84. At least 180° of rotation capability is provided to extensible arm 81 so that arm 80 may be extended and retracted in both directions normal to pipe manipulating arm 81. Preferably arm 81 is provided with a capability to rotate up to about 240° on bracket 84 to increase the flexibility of the device.

Gripping hand 28 is not independently rotatable about the end of extensible arm 80, but may be opened and closed using a double acting cylinder mechanism such as illustrated in FIGS. 5, 7 and 9. Extensible arm 81 is constructed of telescoping members similar to but typically smaller than those of arm 81.

The apparatus of FIG. 9 is affixed in the well derrick by means of mounting plates such as 85 in the same manner as the FIG. 4 embodiment. Arm 81 extends and retracts along a single line, whereas the rotatability of extensible arm 80 affords the gripping hand 28 access to pipe at any location in a finger board located on either side of arm 81. Controls, not shown, are suitably provided for the apparatus of FIG. 9 and may be vest mounted or located in a console.

In the foregoing discussion of the preferred embodiments of the present invention, reference has been made to the employment of a telescoping hydraulic cylinder to carry out the extension and retraction of the pipe manipulating arm, to carry out the rotation of the pipe gripping hand relative to the arm and to further carry out the opening and closing of the pipe engaging jaws of the gripping hand. While in the preferred embodiment of the present invention hydraulic cylinders are used for each of these purposes, such hydraulic cylinders can be replaced with other suitable means to effect the same purposes, including for example, electric motors and hydraulic motors together with worm gears, rack and pinion mechanisms, or the like. Any of these suitable mechanisms can be advantageously utilized in accordance with the apparatus of the present invention as long as the pipe gripping hand is capable of both gripping engagement of the length of pipe and rotational movement relative to the arm of the apparatus.

Moreover, while not shown in the accompanying drawings, any conventional hydraulic system can be utilized in accordance with the present invention to operate the various hydraulic cylinders utilized. The design of such hydraulic system to meet the specific purposes of the apparatus of the present invention can be easily carried out by one skilled in the art. It need only be noted in this regard that in the preferred embodiment the pair of cylinders which effect the rotational movement of the pipe gripping hand relative to the arm of the derrick mounted apparatus are oppositely acting cylinders so that where one of the pair of cylinders is pressurized, the other cylinder is unpressurized, thereby providing the required movement of the sprocket for rotation.

The derrick mounted apparatus of the present invention has a minimum of working parts and is quite simplified compared to previously developed devices. This, coupled with the efficient and effective manner in which the apparatus of the present invention allows the manipulation of pipe in and out of one or more finger boards, provides for a substantial improvement over that which has been previously proposed.

While the present invention has been described primarily with regard to the foregoing specific exemplification, it should be understood that the present invention cannot, under any circumstances, be deemed limited thereto, but, rather, must be construed as broadly as any and all equivalents thereof.

What is claimed is:

1. Derrick mounted apparatus for the manipulation of links of pipe comprising in combination at least one finger board for holding links of pipe, and a pipe manipulating apparatus located in proximity to said finger board and comprising:

a pipe manipulating arm having a first end fixed within said derrick and a second end adapted to extend and retract along a pre-determined line;

an extensible arm rotatably mounted on the second end of said pipe manipulating arm;

a pipe gripping hand comprising pipe engaging jaws rotatably attached to the extensible arm, said pipe gripping hand being rotatable in a substantially horizontal plane and said extensible arm being adapted for extending and retracting said pipe gripping hand from said second end of said pipe manipulating arm;

means operative to close or open said pipe engaging jaws to accept or discharge a length of pipes;

means operative to rotate said pipe gripping hand relative to said extensible arm; and means operative to extend and retract said pipe manipulating arm and said extensible arm.

2. The apparatus of claim 1 wherein the means are operative to extend and retract the pipe manipulating arm and the extensible arm comprises at least one hydraulic cylinder for each said arm.

3. The apparatus of claim 1 wherein the means operative to close or open the pipe engaging jaws comprises a hydraulic cylinder linked to said pipe gripping hand to open and close said jaws upon application of hydraulic pressure.

4. The apparatus of claim 1 wherein the means operative to rotate the pipe gripping hand comprises a pair of oppositely acting hydraulic cylinders and a chain drive connecting said pipe gripping hand to said extensible arm.

5. The apparatus of claim 4 wherein the chain drive includes a chain and sprocket, said chain being attached at each end to one of said pair of hydraulic cylinders, said sprocket being attached to said gripping hand for rotation of the gripping hand relative to the extensible arm whereby, through the actuation of said oppositely acting hydraulic cylinders, said chain through said sprocket rotates said gripping hand.

6. The apparatus of claim 1 wherein said apparatus is located adjacent at least one finger board in said derrick.

7. The apparatus of claim 1 wherein said apparatus is located between two finger boards.

8. The apparatus of claim 1, wherein the extension and retraction of said pipe manipulating arm and said extensible arm is sufficient to enable said pipe gripping hand to engage a pipe in any position in said finger board.

9. The apparatus of claim 1, wherein said pipe manipulating arm and said extensible arm are comprised of co-axial telescoping members.

* * * * *